US011795782B2

(12) United States Patent
Byberg et al.

(10) Patent No.: US 11,795,782 B2
(45) Date of Patent: Oct. 24, 2023

(54) ROTATING STINGER VALVE FOR J-SLOT CONNECTOR

(71) Applicant: Archer Oiltools AS, Stavanger (NO)

(72) Inventors: Arve Byberg, Klepp Stasjon (NO); Daniel Agerup Bull, Stavanger (NO)

(73) Assignee: Archer Oiltools AS, Stavanger (NO)

( * ) Notice: Subject to any disclaimer, the term of this patent is extended or adjusted under 35 U.S.C. 154(b) by 0 days.

(21) Appl. No.: 17/193,591

(22) Filed: Mar. 5, 2021

(65) Prior Publication Data

US 2021/0277745 A1 Sep. 9, 2021

(30) Foreign Application Priority Data

Mar. 6, 2020 (NO) ..... 20200272

(51) Int. Cl.
*E21B 23/00* (2006.01)
*E21B 34/14* (2006.01)
(Continued)

(52) U.S. Cl.
CPC ..... *E21B 34/14* (2013.01); *E21B 23/006* (2013.01); *E21B 33/1294* (2013.01); *E21B 33/134* (2013.01); *E21B 2200/06* (2020.05)

(58) Field of Classification Search
CPC .... E21B 2200/06; E21B 23/006; E21B 34/14; E21B 33/1294; E21B 33/134
See application file for complete search history.

(56) References Cited

U.S. PATENT DOCUMENTS 4,487,261 A 12/1984 Gazda
5,029,643 A * 7/1991 Winslow ..... E21B 33/1291 166/131
(Continued)

FOREIGN PATENT DOCUMENTS

CA 2569713 A1 * 4/2000
CA 2395723 A1 * 2/2003 ..... E21B 33/134

OTHER PUBLICATIONS

Norwegian Search Report for application No. 20200272 dated Mar. 27, 2020.

*Primary Examiner* — D. Andrews
*Assistant Examiner* — Ronald R Runyan
(74) *Attorney, Agent, or Firm* — Birch, Stewart, Kolasch & Birch, LLP

(57) ABSTRACT

A petroleum well toolstring valve includes a drill pipe string conveyed J-slot running tool for a top stinger on a retrievable bridge plug. The J-slot running tool includes a J-slot sleeve with J-slots for disconnectably receiving the stinger. The top stinger includes a cylindrical stinger portion with J-slot connecting lugs. An internal plug is arranged between a central connector and stinger bores. A cylindrical neck on the stinger portion spans the internal plug in the axial direction. The cylindrical neck, when covered by the J-slot sleeve, forms an annular flow space connecting upper and lower radial ports and thus central bores. The stinger portion has a rotatable sleeve valve body arranged on a stinger valve stem portion. The sleeve valve body has a sleeve valve port arranged for being aligned with the lower stinger port when rotated into an open position. The rotatable sleeve valve body is connected to the lugs for being rotated by the drill pipe string for opening or closing the valve.

9 Claims, 5 Drawing Sheets

Figure 1:
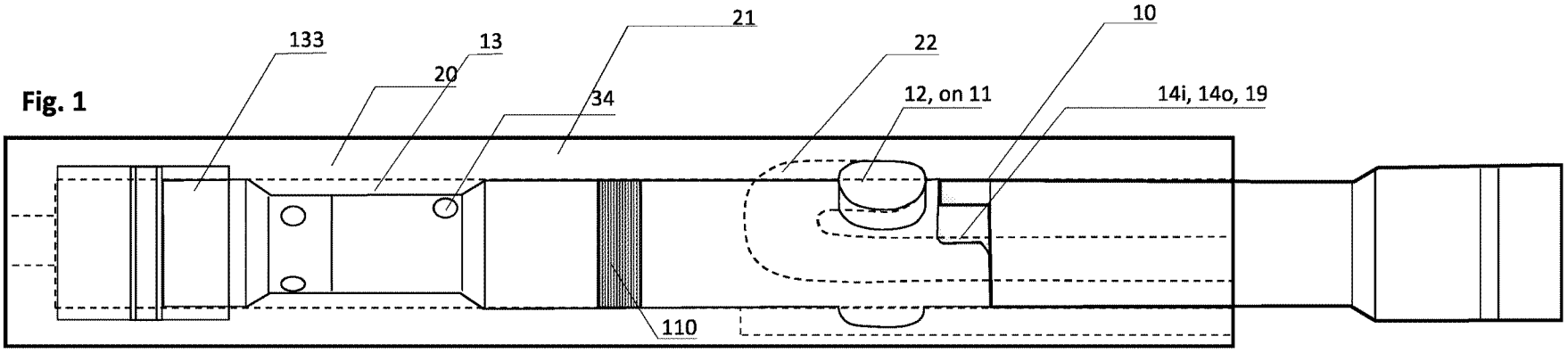

(51) Int. Cl.
*E21B 33/129* (2006.01)
*E21B 33/134* (2006.01)

(56) References Cited

U.S. PATENT DOCUMENTS

| | | | | |
|---|---|---|---|---|
| 5,697,449 | A | 12/1997 | Hennig et al. | |
| 2017/0037706 | A1* | 2/2017 | Cho | E21B 34/12 |
| 2018/0106130 | A1 | 4/2018 | Styler et al. | |
| 2021/0317723 | A1* | 10/2021 | Wardley | E21B 23/06 |

* cited by examiner

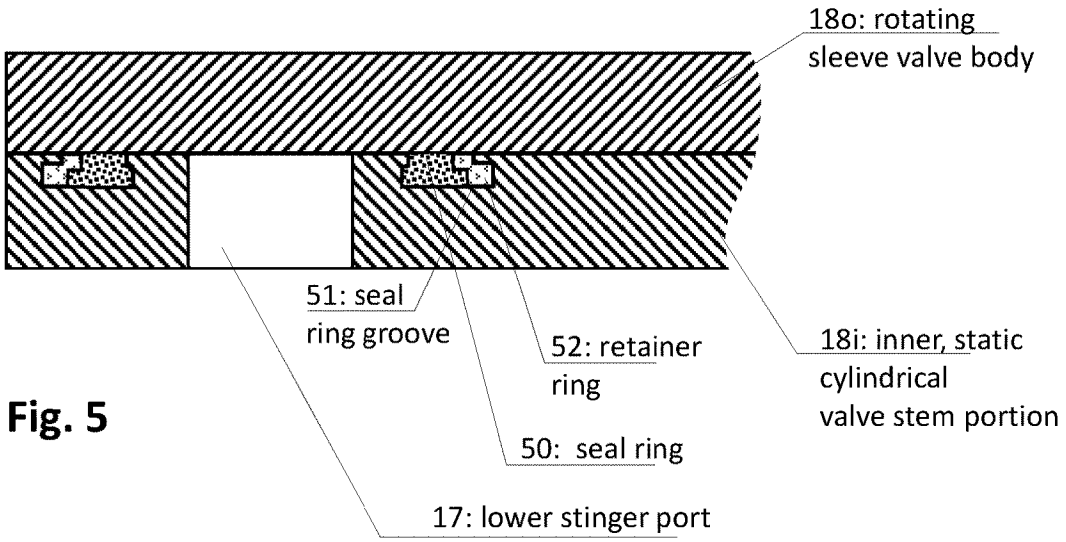
Fig. 5
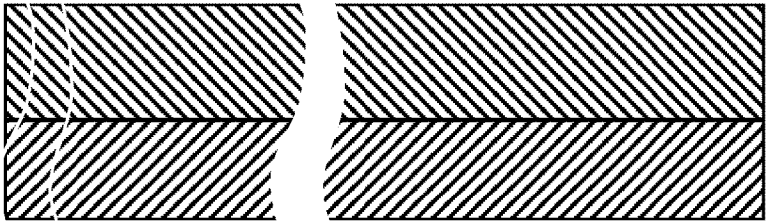

ROTATING STINGER VALVE FOR J-SLOT CONNECTOR

INTRODUCTION

The present invention is a petroleum well toolstring valve comprising a drill pipe string (0)-conveyed J-slot running tool (20) for a top stinger (10) on a retrievable bridge plug (40), both having a central connector and stinger bores (30, 32). More specifically, the present invention is a tool-axial cylindrical valve for being opened and closed by rotation of the drill pipe string to the left or to the right.

Background and problems related thereto One of the main purposes of having fluid communication through a removable prior art bridge plug with a stinger and a prior art J-slot sleeve running tool, and further through the bore of a drill pipe string, is to enable ventilating and balancing out gas and fluid pressure from below the plug in order to enable releasing the slips and packer of the plug without any pressure or gas gradient across the plug.

Therefore, in the prior art, the applicant so far has relied on using a ball valve for closing and opening the main bore through the plug mandrel. That valve is closed after setting the slips and packer seal of the plug in a casing, and before disconnecting the prior art J-slot tool. When reconnecting after some elapsed time, such as hours, weeks or several months, gas may have accumulated below the packer or in the main bore of the plug, and the ball valve is opened to test the pressure below the packer, before releasing the packer and the slips. The prior art plug may have a radial valve in the mandrel below the packer so as for balancing the pressure across the mandrel, too.

Usually the central bore of the drill pipe string, the prior art central connector bore, and the prior art central stinger bore are in direct fluid communication in order for controlling the below prior art plug with fluid communication such as pressure and flow rate, directly from the drilling rig at the surface. Also usually, in order to open or close between the prior art central connector bore and the central stinger bore there is arranged a ball valve, which is a rather delicate, multi-component tool part which is costly, vulnerable, and which requires much maintenance between runs.

The large seal diameter of the prior art ball valve seals (above and below the ball) requires a large mechanical moment to rotate the ball if the ball is under pressure from below or above, so the opening mechanism may be severely strained.

BRIEF SUMMARY OF THE INVENTION

The invention solves some or all of the above mentioned problems, and is defined in the independent attached claim. Embodiments of the invention are defined in the dependent claims.

BRIEF FIGURE CAPTIONS

The invention is illustrated in the attached drawings, wherein

FIG. 1 is an illustration view of an embodiment of the invention wherein a stinger (10) with a valve according to the invention is extending from the right of the drawing, and illustrated as arranged in a run-in conveyed position and prevented from collapsing by a spline sleeve (112) in an outlined section of a J-slot sleeve (21) of a running tool (20), a so-called J-slot connector. A novel feature of the stinger (10) readily visible in the drawing is the neck (13) formed at the stinger portion (11) and its related upper and lower ports. Up is to the left in the drawing, down into the well is to the right. A lower connection (41) for the central bore (32) to the central bore of a below plug (40) is to the right. A central bore (30) for being connected to the bore of a drill pipe string is to the left.

Figure 2:
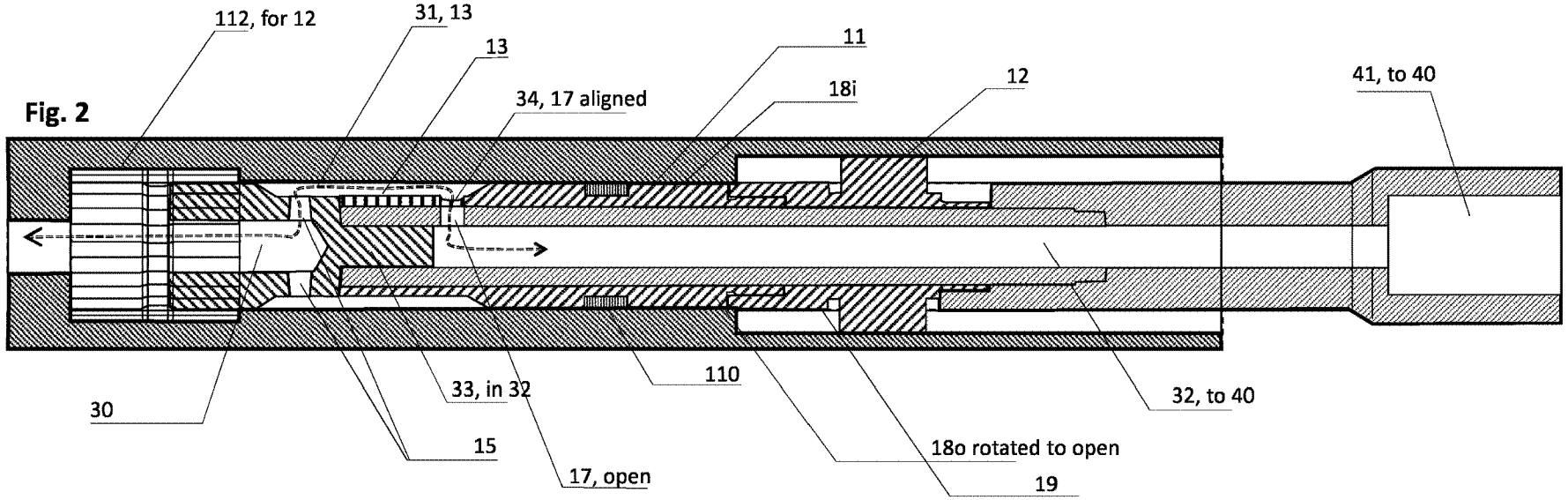

FIG. 2 is an axial section of the stinger and an outlined axial section of the associated J-slot connector running tool (20). An important feature is the rotating sleeve valve body (18*o*) (o for "outer") which is provided with a sleeve valve port (34) for opening or closing the lower stinger port (17) to the lower central bore (32) of the stinger (10). The rotating sleeve valve body (18*o*) is connected to the lugs (12) so as for being rotated right-hand (RH) or left-hand (LH) by the J-slots of the J-slot running tool (20).

Figure 3:
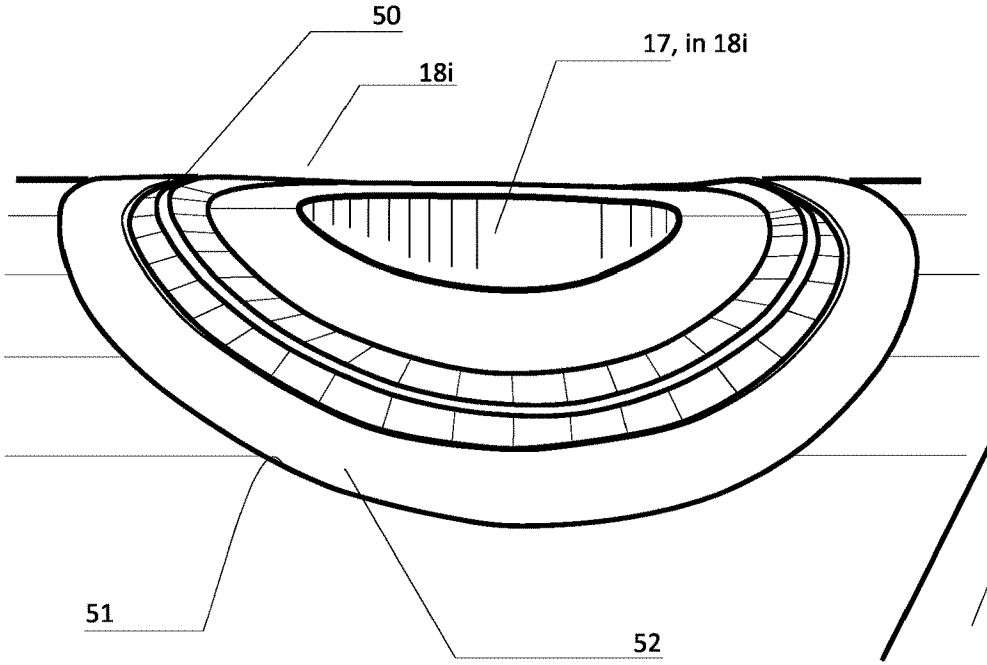

FIG. 3 is an image of the sleeve valve port (17) in the inner, static valve stem portion (18*i*), seen from a near-tangential transverse view angle relative to the port. A seal ring (50) held by a seal retainer ring (52) such as a rigid, flexible PEEK, is shown. The seal groove (51) is milled into the outer surface of the cylindrical stem portion (18*i*) in a way as to ensure a wrapped cross-section profile in the cylindrical surface: a flat, circular retainer ring (52) is snapped into the wrapped groove (51) to hold the seal ring (50). One significant advantage of the present invention is the relatively small diameter of the seal ring (50), thus its small exposed area subject to friction from the surrounding rotating sleeve body (18*o*), thus reducing friction and wear during opening and closing.

Figure 4:
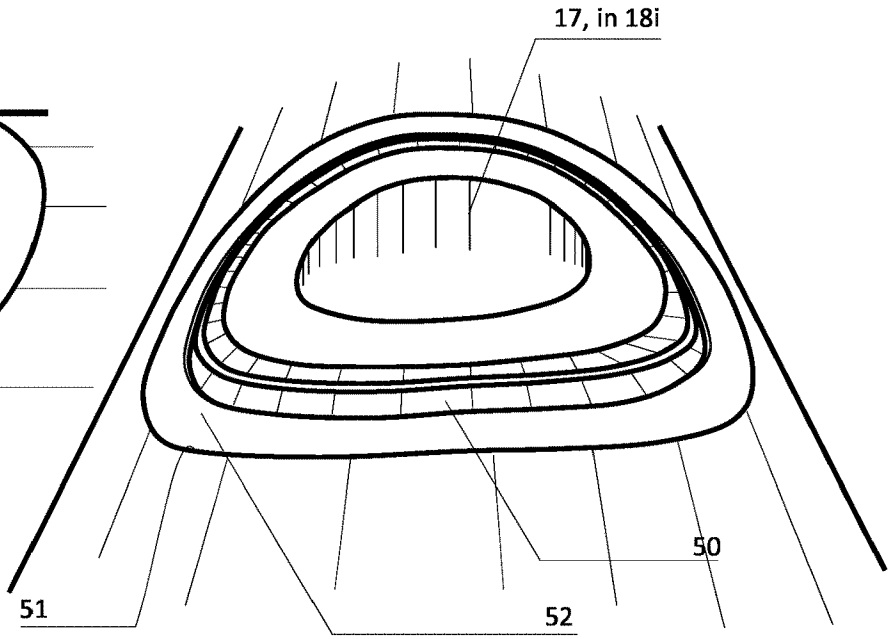

FIG. 4 is an oblique near-axial image of the same sleeve valve port (17). Also here is shown how the ring groove (51) is milled as if it wraps into the cylindrical surface about the port (17). The port (17) may be a simple cylindrical lateral bore drilled into the valve stem portion (18*i*).

FIG. 5 is an illustration of an axial section of the inner and outer sleeve valve portions (18*i*, 18*o*) in the vicinity of the port (17). A longitudinal section of the lower port (17) and the seal and seal retainer rings (50, 52) is shown.

Figure 6:
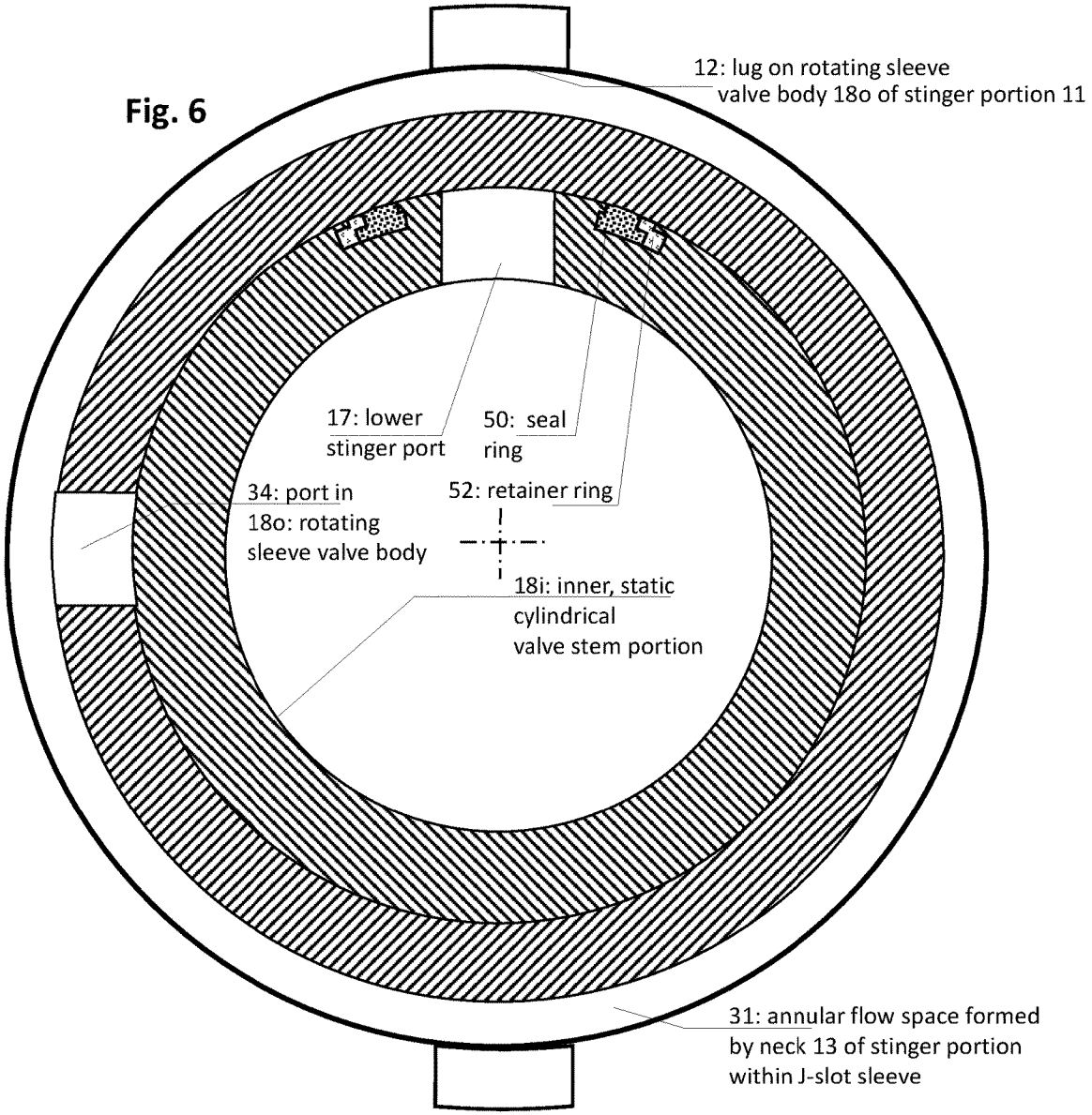

FIG. 6 is a corresponding cross section of the inner and outer sleeve valve portions (18*i*, 18*o*) in the vicinity of the port (17). A circular cross section of the lower port (17) and the wrapped seal and seal retainer rings (50, 52) is shown. Lugs (12) are shown on the rotatable outer valve body (18*o*) with its port (34) rotated 90 degrees out of alignment with the stinger port (17).

Figure 7:
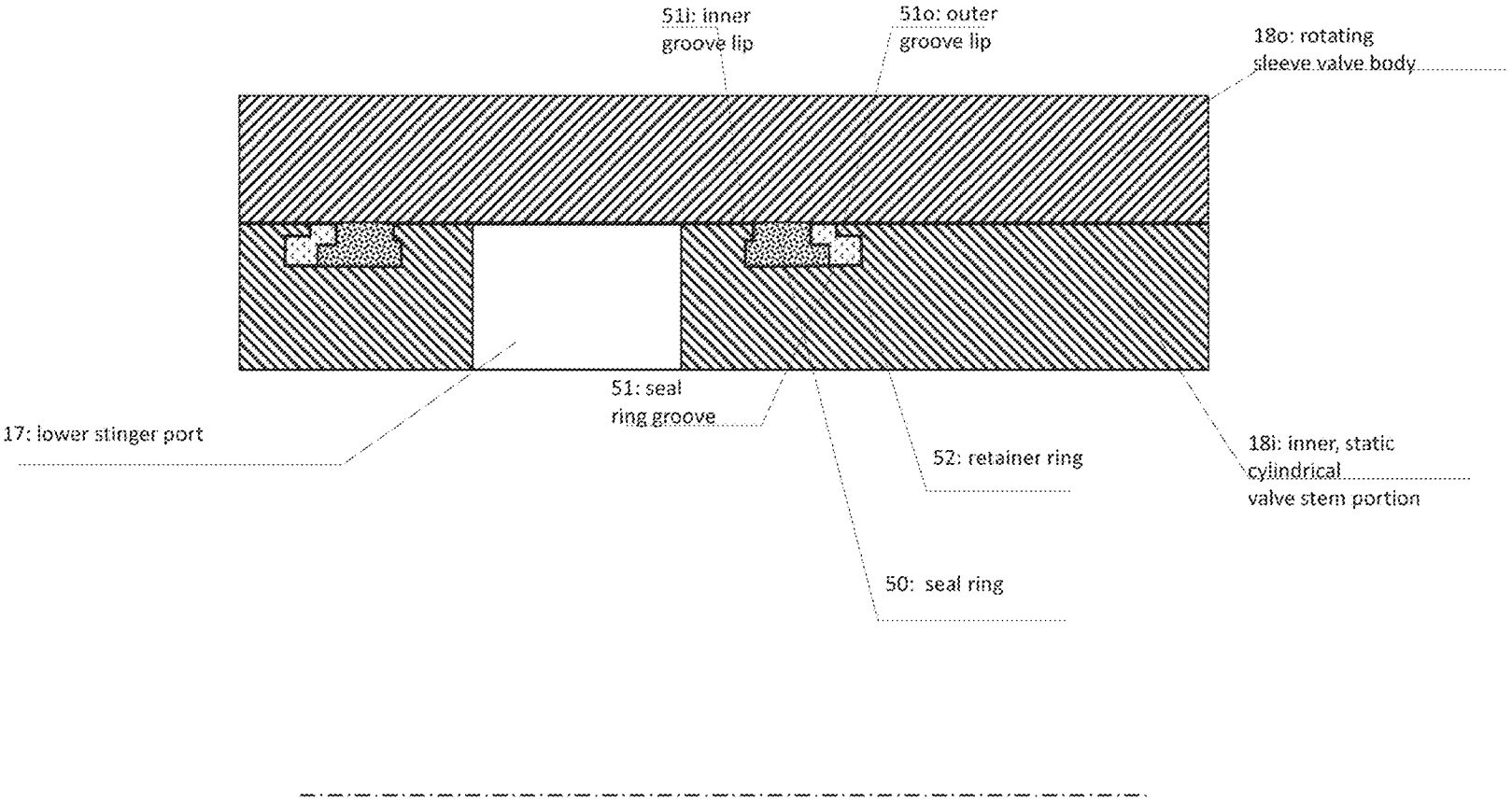

FIG. 7 is a detailed view of an upper portion of FIG. 5.

EMBODIMENTS OF THE INVENTION

The invention provides a petroleum well toolstring valve comprising a drill pipe string (0)-conveyed J-slot connector (20) for a stinger (10) on a retrievable bridge plug (40), which may be called a tool (40).

The J-slot connector (20) has the following main components:

- a central connector bore (30) which is fluid communicating upwardly with said drill pipe string (0), and
- a J-slot sleeve (21) with J-slots (22) for disconnectably running, disconnecting and retrieving said stinger (10). The J-slots (22) are open downwardly in one of their "legs".

The stinger (10) has the following main components:

- a cylindrical stinger portion (11) with
  a central stinger bore (32);
- J-slot connecting lugs (12), and
- a lower connection (41) to the tool (40) such as a retrievable bridge plug (40), arranged for working in selectable fluid communication with said central bore (30) and thus said drill pipe string (0).

One of the main purposes of having fluid communication through the plug (40) via the stinger (10) and the J-slot sleeve (21) and further through the drill pipe string (0), is to enable ventilating and balancing out gas and fluid pressure from below the plug (40) in order to enable releasing the slips and packer of the plug without any pressure or gas gradient across the plug.

Usually the central bore of the drill pipe string (0), the central connector bore (30), and the central stinger bore (32) are in direct fluid communication in order for controlling the below tool (40) with fluid communication such as pressure and flow rate, directly from the drilling rig at the surface. Also usually, in order to open or close between the central connector bore (30) and the central stinger bore (32) there is arranged a ball valve, which is a rather delicate, multi-component tool part which is costly, vulnerable, and which requires much maintenance between runs.

In the present invention the central stinger bore (32) is isolated from the central connector bore (30) by an internal plug (33). The stinger portion (11) has a cylindrical neck (13) spanning said internal plug (33) in the axial direction, and is provided with an upper radial port (15) into said central connector bore (30) which communicates upwardly, and a lower radial port (17) into said stinger central bore (32) which communicates downwardly, so as for said cylindrical neck (13), when covered by said J-slot sleeve (21), forms an annular flow space (31) connecting said upper and lower radial ports (15, 17) and thus said central bores (30, 32). The opening and closing the fluid communication between said upper connector bore (30) and lower stinger bore (32) is by opening and closing the lower radial port (17):

The stinger portion (11) has a flush rotatable sleeve valve body (18*o*) arranged on a cylindrical inner, static, stinger valve stem portion (18*i*) of said stinger portion (11) and extending at least to above said lower stinger port (17), and the sleeve valve body (18*o*) has a sleeve valve port (34) arranged for being aligned with said lower stinger port (17) when rotated into an open position. Further, the rotatable sleeve valve body (18*o*) is connected to the lugs (12) and rotated together with those, for being rotated RH or LH by the J-slot sleeve (21) which is a running tool conveyed on the drill pipe string (0), in order to open or close the lower stinger port (17).

There are significant advantages of this simple arrangement. A ball valve, which is a delicate mechanism and which requires a solid, through bore ball valve element wherein the through bore opening is less than a quarter of the circumference of the ball, and which requires two vulnerable full bore seals above and below the ball, and a link arm mechanism for opening or closing linked to a rotating sleeve, an axially translating sleeve, or both. The ball valve mechanism is costly to build, and costly to maintain, and the maintenance may be necessary to conduct for each time the ball valve has been run. The ball valve mechanism must be disassembled for inspecting the valve seals. Contrary to the ball valve mechanism, the valve of the present invention may be operated by rotating the lugs using the running tool rotated by the drill pipe string. The mechanism closes by a quarter turn to left and opens by the opposite turn, to the right, or vice versa, depending on the preference of the mechanical designer. Sealing the lateral port (17) requires a significantly smaller seal than a full bore seal, thus the seal friction in the valve element of the present invention is less than the seal friction in the ball valve mechanism of the prior art, which results in a smaller required rotational moment and less wear for operating the present invention.

A further advantage, when requiring less torque due to less friction for opening or closing, we have reduced the risk of breaking/unscrewing a threaded connection in the drill pipe string upon opening or closing, the one of those which requires left hand rotation (LH). We also save rig time because we need to establish less torque. The invention thus results in increased operation safety and reduced rig time.

In an embodiment of the invention, In the valve, the rotating sleeve valve body (18*o*) and the static valve stem portion (18*i*) has rotation delimiter shoulders (14*o*, 14*i*), respectively, arranged for limiting mutual LH or RH rotation relative to said stinger portion (11). It is practical to limit the mutual rotation to 90 degrees, and at least to less than about 180 degrees, due to the mechanical strength of the shoulders (14*o*, 14*i*). In an embodiment of the invention the static valve stem portion (18*i*) and the rotating sleeve valve body (18*o*) is provided with one port (17, 34), and may in an alternative be provided with an oppositely arranged pair of ports (17, 34). The person skilled in the art, given the present description and drawings, would of course be capable of devising further ports, but for the present invention, we consider one port (17, 34) as sufficient.

In an embodiment of the invention there is at least one sealing o-ring (110) arranged on said stinger portion (11) between said lugs (12) and said neck (13). The sealing O-ring (110) on the stinger portion (11) may be of rectangular cross-section or of circular cross-section. The sealing O-ring (110) will sit at the exposed surface of the stinger portion (11) and should be rather rugged considering its use which includes stabbing under usually particle polluted conditions.

In an embodiment of the invention, please see FIGS. 3 and 4, and also FIGS. 5 and 6, illustrates a seal ring (50) arranged about said lower stinger port (17), said seal ring (50) arranged in a ring-shaped groove (51) milled into in said cylindrical stinger mandrel portion (18*i*, 110). The small diameter of the seal ring (50) provides a small exposed seal area. In an embodiment of the invention the seal ring (50) is held in the ring-shaped groove (51) by a ring-shaped seal retainer (52) which snaps into the seal groove (51) by means of having larger diameter than an outer lip of the milled groove.

The Workings of the Invention

Archer's valve is operated by a J-slot connector with a J-slot inside the cylindrical sleeve for connecting to the stinger with the lugs. The top of the stinger abuts in a spline sleeve to hold the lugs in place in the J-slot when running in. Rotation to open and close the valve. Weight down to compress the stinger into the J-slot connector tool, and rotate to release. The J-slot connector has a central bore and is conveyed on a drill pipe string, and used in the ordinary way.

The opening and closing of the valve is done by rotating the drill pipe string, thus rotating the lugs (12) with the stinger portion (11)'s rotating sleeve valve body (18), see the yellow sleeve above, for aligning the transverse port (34) of rotating sleeve valve body (18), with the transverse port (17) of the cylindrical stem with the central bore (32) of the stinger, which communicates with the plug below.

The central bore (32) is blocked by an internal plug (33). When the port (17, 34) is open, the central bore (32) of the stinger communicates via an internal annular flow space (31)

with another port (15) to the upper central bore (30) of the J-slot connector, further communicating with the drill pipe string.

The invention claimed is:

1. A petroleum well toolstring valve comprising:

a J-slot sleeve with J-slots and a central bore;

a top stinger having a cylindrical stinger portion with J-slot connecting lugs for disconnectedly engaging the J-slots of the J-slot sleeve and a stinger bore;

wherein an internal plug is arranged between said J-slot sleeve central bore and the stinger bore, a cylindrical neck on said stinger portion spanning said internal plug in the axial direction, with an upper radial port into said J-slot sleeve central bore, and a lower radial port into said stinger central bore, wherein said cylindrical neck, when covered by said J-slot sleeve, forms an annular flow space, fluidly connecting said upper radial port and the lower radial port to connect the central bore and the stinger bore, wherein said stinger portion has a sleeve valve body arranged on a cylindrical inner, static, stinger valve stem portion of said stinger portion, the stinger valve stem portion extending at least to above said lower radial port, and wherein said sleeve valve body has a sleeve valve port arranged for being aligned with said lower radial port when rotated into an open position, said sleeve valve body connected to said lugs for being rotated by a drill pipe string for opening or closing said valve.

2. The petroleum well toolstring valve of claim 1, said sleeve valve body and said stinger valve stem portion having rotation delimiter shoulders, respectively, arranged for limiting mutual rotation relative to said stinger portion.

3. The petroleum well toolstring valve of claim 2, comprising at least one sealing o-ring arranged on said stinger portion between said lugs and said cylindrical neck.

4. The petroleum well toolstring valve of claim 3, further comprising a seal ring arranged about said lower radial port, said seal ring arranged in a ring-shaped groove in said stinger valve stem portion.

5. The petroleum well toolstring valve of claim 4, further comprising a spline sleeve holding a top portion of the internal plug in an upper portion of the J-slot sleeve.

6. The petroleum well toolstring valve of claim 4, wherein said seal ring is held in said ring-shaped groove by a ring-shaped seal retainer.

7. The petroleum well toolstring valve of claim 6, wherein said ring-shaped groove is milled into a cylindrical surface of said stinger valve stem portion so that said groove is draped around said stinger valve stem portion, wherein the groove is milled to a constant radial depth in the cylindrical surface all the way about the radial lower radial port.

8. The petroleum well toolstring valve of claim 6, wherein said ring-shaped groove is milled into the cylindrical surface of said stinger valve stem portion so that said groove is draped around said stinger valve stem portion.

9. The petroleum well toolstring valve of claim 8, wherein the top stinger has a lower connection configured to connect to a retrievable bridge plug for working in selectable fluid communication with said central bore.

* * * * *